US007161297B2

(12) United States Patent
Kotera et al.

(10) Patent No.: US 7,161,297 B2
(45) Date of Patent: Jan. 9, 2007

(54) ELECTRON EMISSION THIN-FILM, PLASMA DISPLAY PANEL COMPRISING IT AND METHOD OF MANUFACTURING THEM

(75) Inventors: Koichi Kotera, Osaka (JP); Yoshinao Ooe, Kyoto (JP); Hiroki Kono, Suita (JP); Hiroyosi Tanaka, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 182 days.

(21) Appl. No.: 10/275,795

(22) PCT Filed: May 11, 2001

(86) PCT No.: PCT/JP01/03938

§ 371 (c)(1),
(2), (4) Date: Jun. 2, 2003

(87) PCT Pub. No.: WO01/86685

PCT Pub. Date: Nov. 15, 2001

(65) Prior Publication Data

US 2004/0056594 A1 Mar. 25, 2004

(30) Foreign Application Priority Data

May 11, 2000 (JP) ..... 2000-138644

(51) Int. Cl.
*H01J 17/49* (2006.01)
*H01J 1/14* (2006.01)
*H01J 9/12* (2006.01)
*H01J 9/14* (2006.01)

(52) U.S. Cl. ..... 313/582; 313/311; 313/633; 313/630; 313/631; 445/12; 445/22; 445/24; 445/49; 445/51

(58) Field of Classification Search ..... 313/311, 313/352, 336, 338, 351, 582
See application file for complete search history.

(56) References Cited

U.S. PATENT DOCUMENTS 4,524,297 A * 6/1985 Gartner ..... 313/346 R
5,537,000 A * 7/1996 Alivisatos et al. ..... 313/506
5,770,921 A * 6/1998 Aoki et al. ..... 313/581

(Continued)

FOREIGN PATENT DOCUMENTS

EP 0 279 744 8/1988

(Continued)

OTHER PUBLICATIONS

Berkenblit, M. et al., "Fabrication Process for Gas Discharge Panels", IBM Technical Disclosure Bulletin, vol. 18, No. 6, Nov. 1975, 2 pages.

(Continued)

*Primary Examiner*—Mariceli Santiago
*Assistant Examiner*—Elizabeth Rielley

(57) ABSTRACT

An electron emission thin-film with improved secondary electron emission characteristics compared with conventional ones, a plasma display panel including the electron emission thin-film, and their manufacturing methods. Using a vacuum deposition system, a protective layer that is an MgO thin-film is formed on a dielectric layer formed on a front glass substrate. At the time of deposition, angles that lines linking the central point of a target material for the protective layer respectively with the central point and both ends points of the front glass substrate form with the front glass substrate are exclusively in a range of 30 to 80 °. This enables at least some of MgO columnar crystals constituting the protective layer to have flat planes that are inclined with respect to the surface of the thinfilm.

26 Claims, 7 Drawing Sheets

U.S. PATENT DOCUMENTS

| | | | | |
|---|---|---|---|---|
| 6,097,138 | A | 8/2000 | Nakamoto | |
| 6,291,943 | B1 * | 9/2001 | Murai et al. | 315/188 |

FOREIGN PATENT DOCUMENTS

| | | | | |
|---|---|---|---|---|
| EP | 0 779 643 | A2 | | 6/1997 |
| JP | 58-144619 | | | 9/1983 |
| JP | 07335116 | A | | 12/1995 |
| JP | 08138531 | A | | 5/1996 |
| JP | 10-125237 | | | 5/1998 |
| JP | 10-149760 | | | 6/1998 |
| JP | 10330193 | | * | 12/1998 |
| JP | 11-149865 | | | 6/1999 |
| JP | 11176325 | A | | 7/1999 |
| JP | 2000123745 | A | | 4/2000 |
| JP | 2001118518 | A | | 4/2001 |
| JP | 2002235238 | A | | 5/2001 |
| WO | 96/32520 | | | 10/1996 |
| WO | WO9909578 | | * | 2/1999 |

OTHER PUBLICATIONS

"Epitaxial Growth, Part A", Edited by J.W. Matthews, IBM Thomas J. Watson Research Center, New York, pp. 91-99.

"Thin Film Process", Edited by John L. Vossen et al., RCA Laboratories, David Sarnoff Research Center, New Jersey, 1978, pp. 340-341.

* cited by examiner

PRIOR ART

ELECTRON EMISSION THIN-FILM, PLASMA DISPLAY PANEL COMPRISING IT AND METHOD OF MANUFACTURING THEM

TECHNICAL FIELD

The present invention relates to an electron emission thin-film used as a protective layer in a plasma display panel and the like, and in particular to a technique for improving electron emission characteristics of the electron emission thin-film.

BACKGROUND ART

In recent years, among color display devices used for image displays in computers and televisions, field emission display panels and plasma display panels (hereafter simply, "PDPs") have received special attention as display devices that can realize slim-type panels. Particularly, PDPs are advantageous in their rapid responses and wide viewing angles, and so companies and research institutions are engaged in active developments to make PDPs widely available.

A PDP has the following construction. A front glass substrate on which a plurality of line-shaped electrodes are arranged in parallel, and a back glass substrate on which a plurality of line-shaped electrodes are arranged in parallel are arranged opposed to each other with gap members interposed between them, in such a manner that the electrodes on the front panel and the electrodes on the back panel are perpendicular. A discharge gas is enclosed in a space formed between the front and back glass substrates. On the surface of the front glass substrate opposing to the back glass substrate, a dielectric layer is formed to cover the electrodes arranged on the front glass substrate. Further, a protective layer, which is an electron emission thin-film, is formed on the dielectric layer.

The PDP is driven in the following way. An address discharge is performed successively between the electrodes on the front glass substrate and the electrodes on the back glass substrate, generating charge on the protective layer surface of cells in which light emission is intended. Then, a sustained discharge is performed between adjacent electrodes on the front glass substrate relating to the cells in which the charge has been generated.

The protective layer on which charge is generated by an address discharge mainly has two functions. The one function is to protect the dielectric layer and the electrodes against ion bombardment (spattering) occurring at the time of address discharge. The other function is a so-called memory function to retain charge by emitting secondary electrons at the time of address discharge. To realize these functions, magnesium oxide (MgO) that excels in resistance to spattering and in secondary electron emission characteristics is commonly used as a material for the protective layer.

In the field of display devices, demands for higher-definition screens have emerged recently. To meet the demands, higher-definition screens are realized by increasing the number of electrodes per unit area of each substrate and thereby increasing the number of cells.

However, the address time to be spent on one cell becomes shorter as a larger number of electrodes are provided to increase the number of cells. The number of secondary electrons emitted from the protective layer at the time of address discharge decreases accordingly, causing the above-described memory function to be degraded. As a result, such a PDP may suffer from erroneous light emission easily occurring along with generation of an erroneous address discharge. With this background, a technique for improving secondary electron emission characteristics of an MgO thin-film is presently being called for.

DISCLOSURE OF THE INVENTION

In view of the above problems, the present invention aims to provide a PDP that includes a protective layer with improved secondary electron emission characteristics and that is less likely to cause erroneous light emission as compared with conventional ones, and to provide a manufacturing method for the PDP. The present invention also aims to provide an electron emission thin-film suitable for the PDP, and a manufacturing method for the electron emission thin-film.

To achieve the above aims, the electron emission thin-film of the present invention is an electron emission thin-film that is formed on a substrate by densely arranging a plurality of columnar crystals so as to extend from the substrate, the columnar crystals being composed of an electron emission material, wherein at a surface of the thin-film, an exposed end of at least one of the columnar crystals has a flat plane that is inclined with respect to the surface.

This electron emission thin-film emits a larger number of secondary electrons than conventional ones. The reason for this can be considered that the columnar crystals constituting the thin-film have higher single-crystallinity than conventional ones.

It is particularly preferable that the flat plane of the at least one of the columnar crystals is inclined at an angle of 5 to 70° with respect to the surface of the thin-film. This is because secondary electron emission characteristics of such columnar crystals are better than those of conventional ones, and so secondary electron emission characteristics of the thin-film are improved.

Also, when the flat planes of the columnar crystals are equivalent to (100) plane of crystal orientation, the columnar crystals emit a larger number of secondary electrons than when the flat planes of the columnar crystals are equivalent to other planes of crystal orientation, such as (110) plane.

Also, the extending direction of each of the columnar crystals is equivalent to <211> direction of crystal orientation.

When the width of each of the columnar crystals is in a range of 100 to 500 nm, the columnar crystals are considered to have high single-crystallinity, and accordingly to have improved secondary electron emission characteristics.

To be more specific, using columnar crystals composed of magnesium oxide enables the electron emission thin-film that excels in secondary electron emission characteristics as well as in resistance to spattering to be formed.

The above thin-film that excels in secondary electron emission characteristics can be formed by depositing a material for forming the thin-film on a substrate in such a manner that an angle at which the material is incident on the substrate is exclusively in a range of 30 to 80°. According to this method, the electron emission thin-film made up of columnar crystals that excel in single-crystallinity can be formed, and therefore, the number of secondary electrons emitted from the electron emission thin-film can be increased.

To be more specific, magnesium oxide can be used as the material for forming the thin-film.

A vacuum deposition method can be employed as a method for forming the electron emission thin-film, thereby enabling the thin-film that excels in secondary electron emission characteristics to be formed in a short time period.

Also, the plasma display panel of the present invention is a plasma display panel that includes a front panel on which first electrodes and a dielectric glass layer that covers the first electrodes are arranged, and a second panel on which second electrodes are arranged, the first panel and the second panel being arranged in such a manner that the dielectric glass layer and the second electrodes are opposed to each other with gap members being interposed therebetween, an address discharge being performed between the first electrodes and the second electrodes to realize addressing, the plasma display panel characterized in that the dielectric glass layer is covered by a protective layer that protects the dielectric glass layer against spattering occurring at the address discharge, the protective layer is formed by a plurality of columnar crystals composed of an electron emission material, and at a surface of the protective layer, exposed ends of the columnar crystals each have a flat plane that is inclined with respect to the surface of the protective layer.

In this plasma display panel, the protective layer excels in secondary electron emission characteristics. Therefore, even if the address time is shortened to deal with demands for higher-definition, generation of erroneous light emission occurring along with an erroneous address discharge can be reduced.

It is particularly preferable that the flat planes of the columnar crystals are inclined at an angle of 5 to 70° with respect to the surface of the protective layer. This is because secondary electron emission characteristics of such columnar crystals are improved in this case, and accordingly, secondary electron emission characteristics of the protective layer are improved.

Here, when the flat planes of the columnar crystals are equivalent to (100) plane of crystal orientation, the columnar crystals emit a larger number of secondary electrons than when the flat planes of the columnar crystals are equivalent to other planes of crystal orientation, such as (110) plane.

To be more specific, the extending direction of each of the columnar crystals is equivalent to <211> direction of crystal orientation.

Also, when the width of each of the columnar crystals is in a range of 100 to 500 nm, the columnar crystals have even higher single-crystallinity, and therefore, the protective layer has improved secondary electron emission characteristics.

Magnesium oxide can be used as a material for forming the protective layer. In this case, the protective layer excels in secondary electron emission characteristics, and also in resistance to spattering at the time of address discharge.

Also, the plasma display panel manufacturing method of the present invention may include a protective layer formation step of forming a protective layer on a dielectric glass layer formed on a substrate, wherein in the protective layer formation step, a material for the protective layer is deposited on the substrate in a reduced-pressure atmosphere, in such a manner that an angel at which the material is incident on the substrate is exclusively in a range of 30 to 80°.

According to this manufacturing method, the protective layer excels in secondary electron emission characteristics. Therefore, the plasma display panel with reduced generation of erroneous light emission occurring along with an erroneous address discharge can be manufactured.

Also, magnesium oxide can be used as the material for forming the protective layer in the protective layer formation step. In this case, the plasma display panel that excels in secondary electron emission characteristics as well as in resistance to spattering at the time of address discharge can be manufactured.

Also, a vacuum deposition method can be used as a method for forming the protective layer in the protective layer formation step. By doing so, the protective layer that excels in secondary electron emission characteristics can be formed in a short time period.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

BEST MODE FOR CARRYING OUT THE INVENTION

The following describes a PDP to which the present invention is applied, with reference to the drawings.

<Overall Construction of the PDP>

Figure 1:
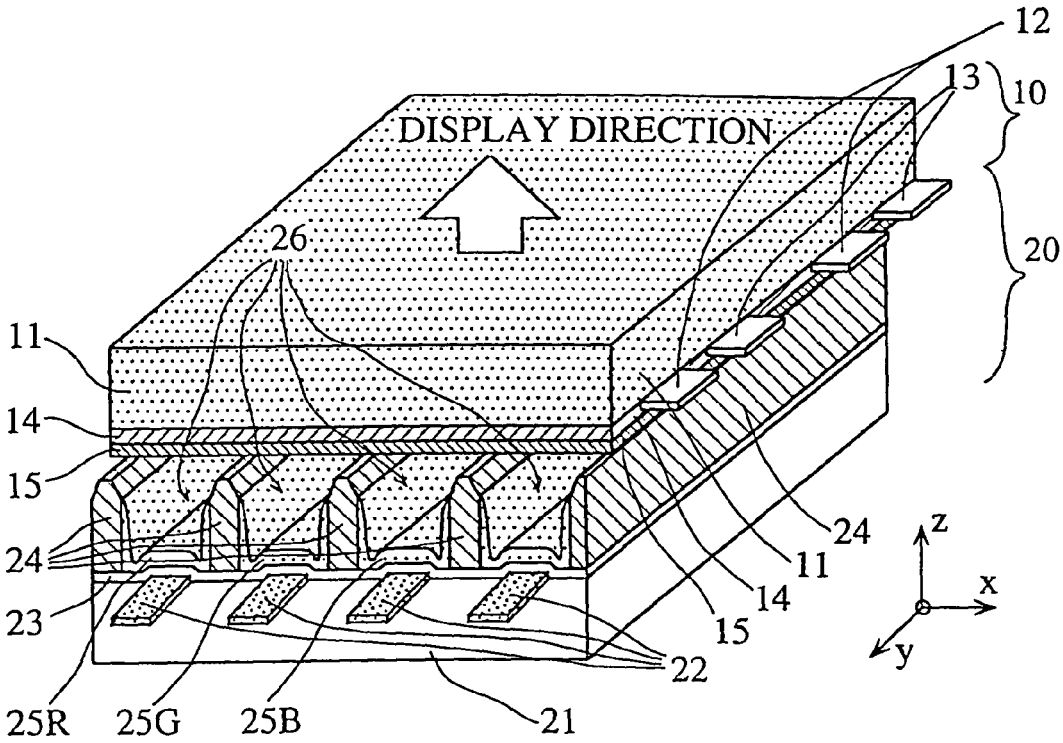
FIG. 1 is a sectional perspective view schematically showing a part of a PDP relating to a preferred embodiment of the present invention.
Figure 2:
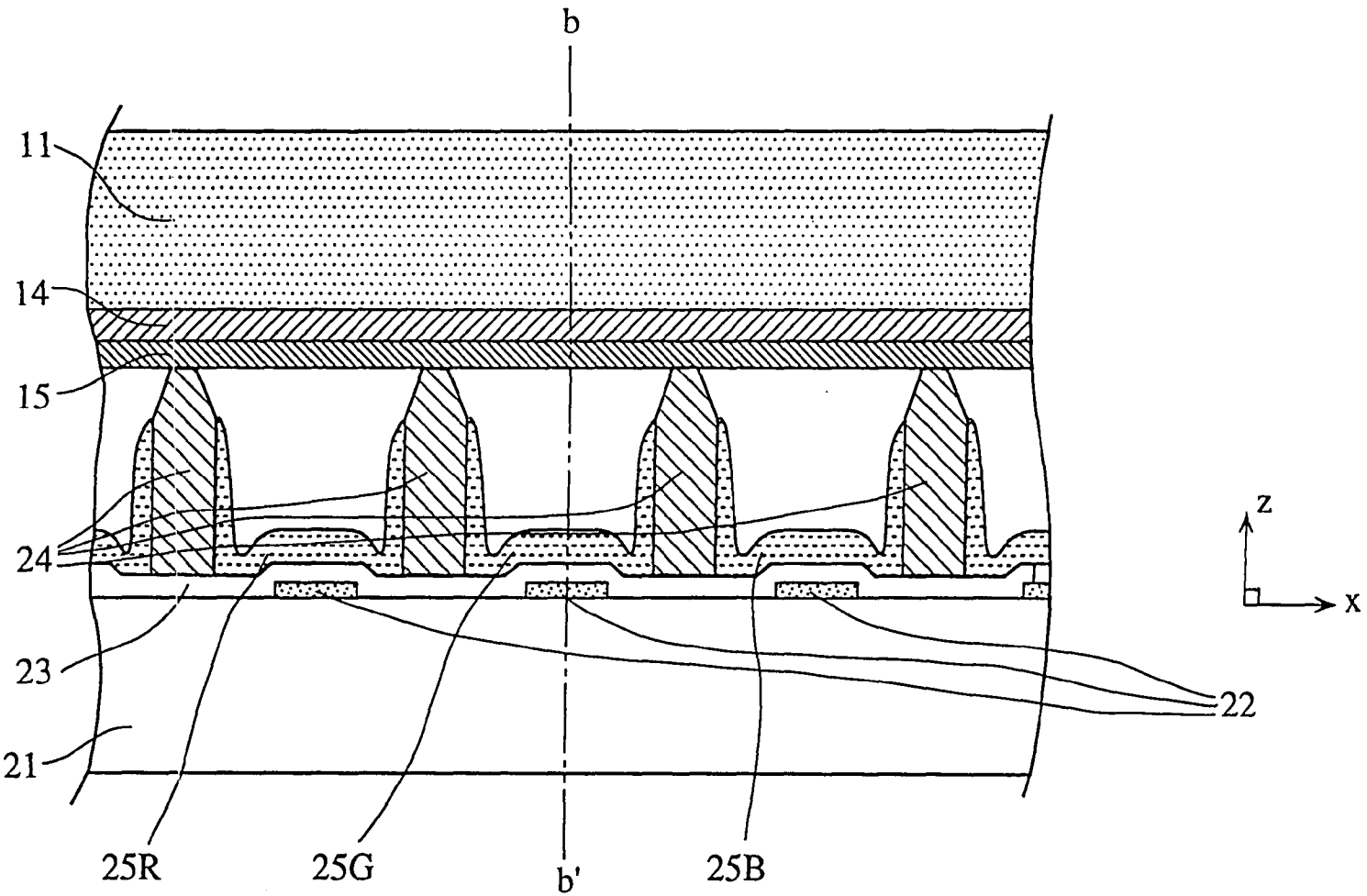
FIG. 2 is an enlarged sectional view showing the part of the PDP as viewed from y-axis direction in FIG. 1.
Figure 3:
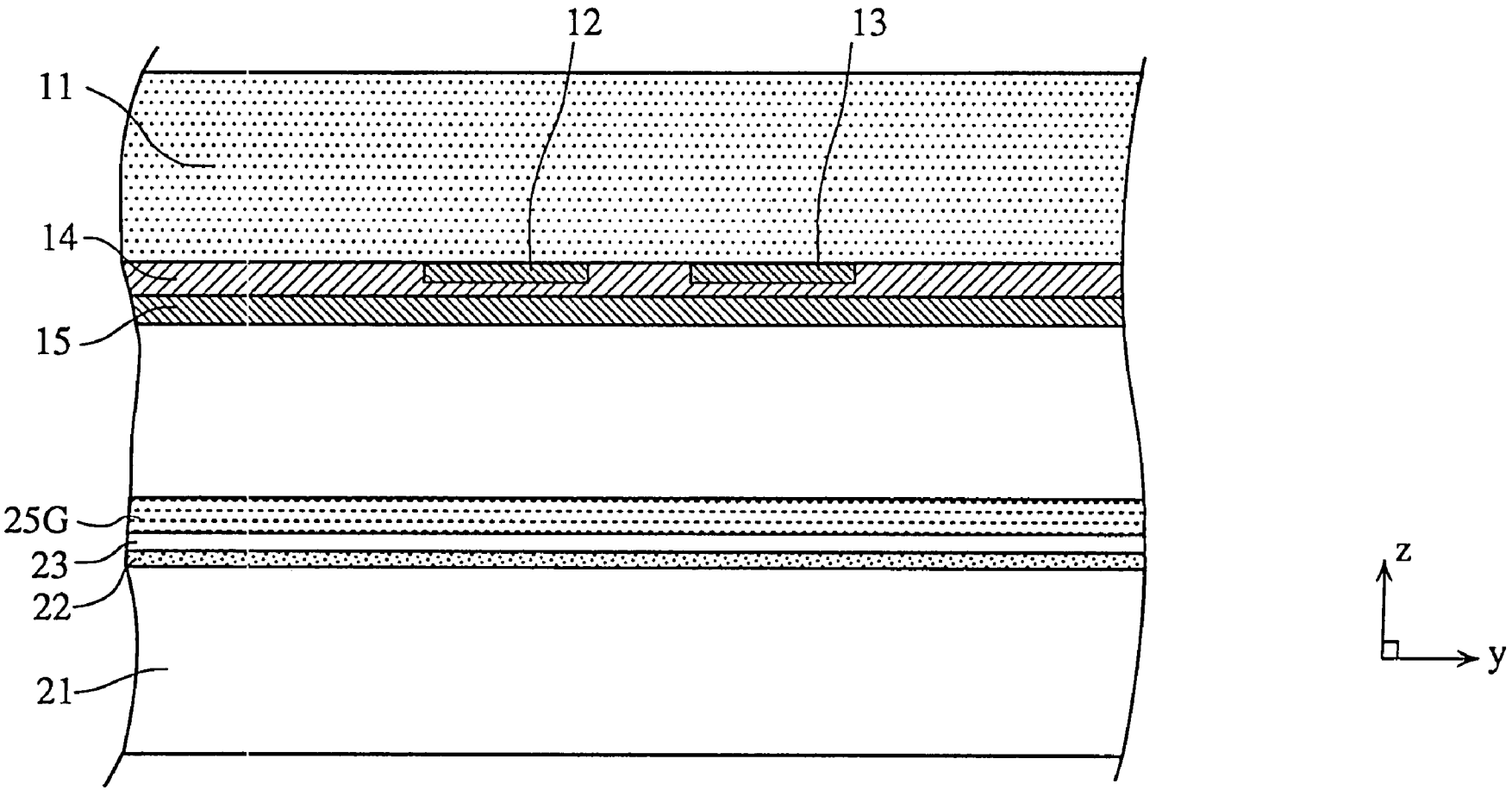
FIG. 3 is a sectional view of the PDP taken along line b–b' in FIG. 2.

FIG. 1 is a sectional perspective view schematically showing the essential components of the PDP of alternating current surface discharge type, as one application example of the present invention. FIG. 2 is a sectional view of the PDP as viewed from y-axis direction in FIG. 1. FIG. 3 is a sectional view of the PDP taken along line b–b' in FIG. 2.

In each figure, z-axis direction corresponds to the thickness direction of the PDP, and x-y plane corresponds to a plane parallel to the panel surface of the PDP.

As FIG. 1 shows, the PDP is roughly composed of a front panel 10 and a back panel 20 that are arranged opposed to each other.

The front panel 10 includes a front glass substrate 11, display electrodes 12 and 13, a dielectric layer 14, and a protective layer 15. As FIG. 3 shows, on the opposing surface of the front glass substrate 11, a plurality of pairs of display electrodes 12 and 13 are alternately arranged in parallel. The dielectric layer 14 is arranged to cover surfaces of the electrodes 12 and 13, and the protective layer 15 is arranged to cover a surface of the dielectric layer 14.

The front glass substrate 11 is a flat-plate substrate made of a sodium borosilicate glass material, and is arranged at the display direction side.

The display electrodes 12 and 13 each have a three-layer structure in which a Cr-layer, a Cu-layer, and a Cr-layer are laminated in the stated order. The display electrodes 12 and 13 each have a thickness of about 2 μm. As these display electrodes, metals such as Ag, Au, Ni, and Pt may be used. Further, to provide a large discharge area within each cell, electrodes each formed by combining a narrow Ag electrode onto a wide transparent electrode made of conductive metal oxide, such as ITO (Indium Tin Oxide), $SnO_2$, and ZnO, may be used as the display electrodes.

The dielectric layer 14 is formed to cover the display electrodes 12 and 13 (with a thickness of about 20 μm). As one example, the dielectric layer 14 may be made of a low-melting glass element, such as lead oxide glass and bismuth oxide glass. Lead oxide glass may be made of a mixture of lead oxide, boron oxide, silicon oxide, and aluminum oxide, whereas bismuth oxide glass may be made of a mixture of bismuth oxide, zinc oxide, boron oxide, silicon oxide, and calcium oxide. The dielectric layer 14 has the function of insulating the display electrodes 12 and 13.

The protective layer 15 is formed to cover the surface of the dielectric layer 14. The protective layer 15 microscopically is a dense layer of columnar crystals that are composed of MgO. The structure of the protective layer 15 is described later in this specification.

Referring back to FIG. 1, the back panel 20 includes a back glass substrate 21, address electrodes 22, a dielectric layer 23, barrier ribs 24, and phosphor layers 25R, 25G, and 25B.

The back glass substrate 21 is, as the front glass substrate 11, a flat-plate substrate made of a sodium borosilicate glass material. On the opposing surface of the back glass substrate 21, the address electrodes 22 are arranged in parallel stripes as FIG. 2 shows.

The address electrodes 22 have, as the display electrodes 12 and 13, a three-layer structure in which a Cr-layer, a Cu-layer, and a Cr-layer are laminated in the stated order. The dielectric layer 23 is formed to cover the address electrodes 22.

The dielectric layer 23 is a dielectric glass layer containing the same glass element as in the dielectric layer 14 in the front panel 10. The dielectric layer 23 insulates the address electrodes 22.

The barrier ribs 24 are arranged parallel with the address electrodes 22 on the surface of the dielectric layer 23. Between every adjacent barrier ribs 24, phosphor layers 25R, 25G, and 25B that respectively emit red, green, and blue light are arranged in the stated order.

The phosphor layers 25R, 25G, and 25B are each formed by bonding phosphor particles emitting the corresponding one of R, G, and B light.

The PDP has the following construction. The front panel 10 and the back panel 20 are arranged opposed to each other, and peripheral parts of the front panel 10 and the back panel 20 are sealed by a sealing layer made of a glass frit (not shown). Within a discharge space 26 formed between the front panel 10 and the back panel 20, a discharge gas (e.g., a mixture gas of neon 95 vol % and xenon 5 vol %) is enclosed at a predetermined pressure (e.g., about 66.5 to 106 kPa).

<Construction of the Protective Layer 15>

Figure 4A:
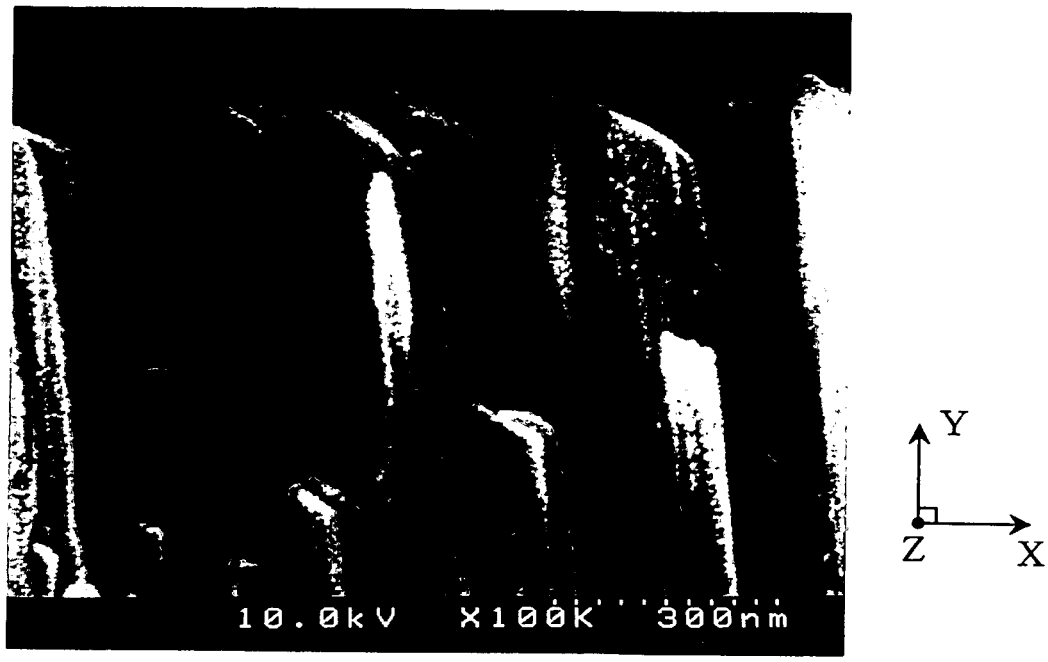
FIG. 4A is a scanning electron micrograph of a section of a protective layer used in the PDP.
Figure 4B:
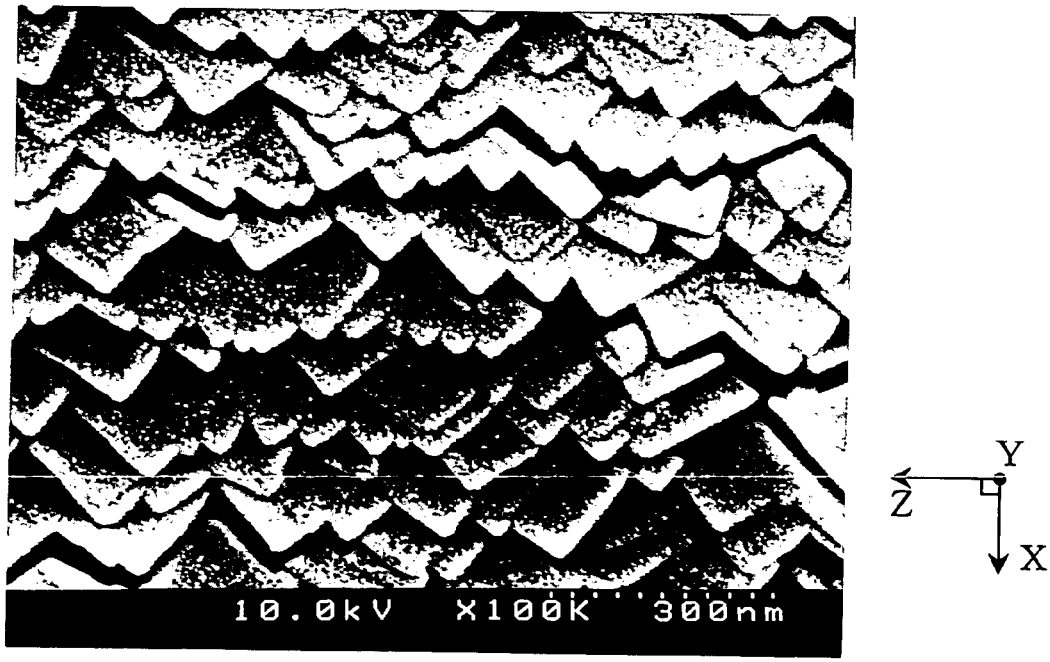
FIG. 4B is a scanning electron micrograph of a plane of the protective layer used in the PDP.

FIG. 4A is a scanning electron micrograph of the protective layer 15 as viewed from the side surface of the front panel 10. FIG. 4B is a scanning electron micrograph of the protective layer 15 in FIG. 4A as viewed from the above. Note here that X, Y, and Z axis directions are shown beside each micrograph for ease of explanation. The dielectric layer 14 is formed in the negative direction of Y axis. In FIGS. 4A and 4B, the axis shown by a black point that is an intersection of the X, Y, and Z axes indicates the direction orthogonal to the paper surface.

As FIG. 4A shows, the protective layer 15 is a dense layer of a plurality of MgO columnar crystals that all extend into one direction. One end of each columnar crystal is exposed.

As FIG. 4B shows, each of the columnar crystals appears to be substantially triangular as viewed from the above.

Figure 5A:
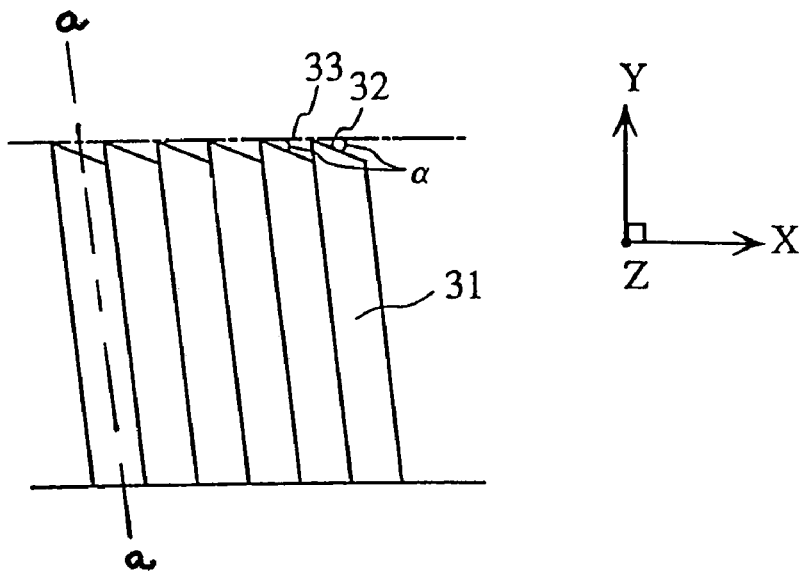
FIG. 5A is a pattern diagram showing columnar crystals in FIG. 4A.
Figure 5B:
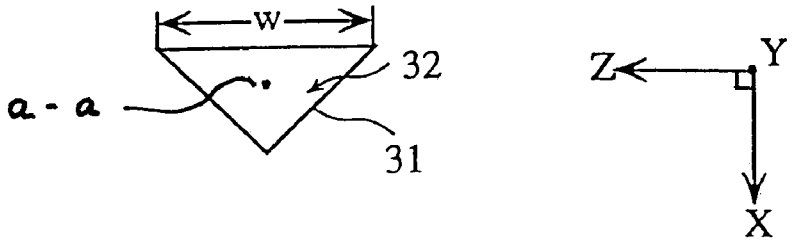
FIG. 5B is a pattern diagram showing a columnar crystal in FIG. 4B.
Figure 5C:
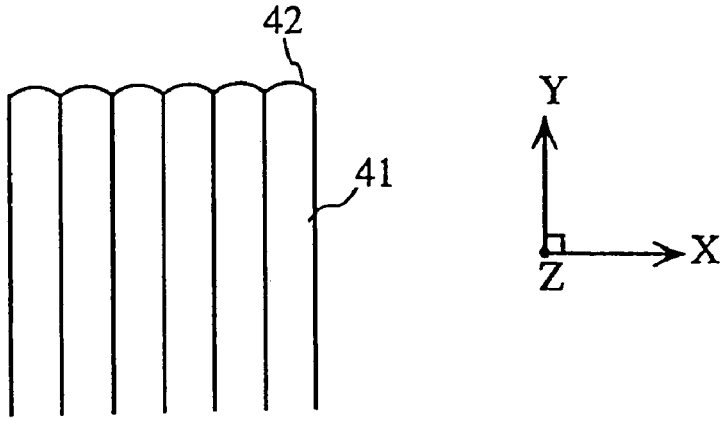
FIG. 5C is a pattern diagram showing columnar crystals formed using a conventional technique.

FIG. 5A is a pattern diagram showing the columnar crystals in the protective layer shown in FIG. 4A. FIG. 5B is a pattern diagram showing one of the columnar crystals in the protective layer viewed from the above in FIG. 4B. FIG. 5C is a pattern diagram showing columnar crystals in a conventional protective layer.

As FIG. 5A shows, a plurality of columnar crystals 31 extend from the dielectric layer 14 in the front panel 10, and a horizontal plane that includes the exposed ends of the columnar crystals constitutes a surface 33 of the protective layer 15.

Each columnar crystal 31 has, at its exposed end, a flat plane 32 that forms angle α with the surface 33. An axis a—a of the columnar crystal extends through the flat plane 32. According to an analysis of crystal orientation using an x-ray diffraction method, the flat plane 32 is equivalent to (100) plane of crystal orientation. Therefore, the columnar crystals 31 are considered to have high single-crystallinity.

A conventional protective layer is commonly formed by a vacuum deposition method in such a manner that MgO is incident on the substrate substantially at an angle of 90°. As FIG. 5C shows, in such a conventional protective layer, the above-mentioned flat planes are not formed at exposed ends 42 of columnar crystals 41. This can be considered because the columnar crystals 41 are not constructed by single crystals but are constructed by polycrystals that each are oriented in a different direction.

The reason for the fact that the columnar crystals 41 constructed by polycrystals are inferior in secondary electron emission characteristics can be considered as follows. The columnar crystals 41 have low single-crystallinity, and so have a number of defects. Therefore, valence electrons flicked out of the columnar crystals 41 when primary electrons are incident on the columnar crystals 41 are less likely to be subject to Bragg reflection caused by a crystal lattice.

On the other hand, the columnar crystals 31 in the present embodiment are constructed by single crystals, and therefore, the columnar crystals 31 have the flat planes 32 that are equivalent to (100) plane. The columnar crystals 31 that are constructed by single crystals are considered to have high crystallinity and a uniform crystal lattice. Therefore, valence electrons flicked out of the columnar crystals 31 are easily subject to Bragg reflection caused by a crystal lattice. Accordingly, a larger number of secondary electrons are emitted from the columnar crystals 31 due to Bragg reflection than from the conventional columnar crystals.

The flat planes 32 of the columnar crystals 31 may be made as equivalent to (110) plane or (100) plane, by changing a temperature of the substrate, a pressure, etc., at the time of deposition. Particularly, it is experimentally verified that the flat planes 32 being made as equivalent to (100) plane have the best secondary electron emission characteristics. It should be noted here that the flat planes 32 may be made as equivalent to (111) plane. However, the flat planes 32 made as equivalent to (111) plane are not flat, and are inferior to the flat planes 32 equivalent to (110) plane, in secondary electron emission characteristics.

It is preferable to set the angle α that each flat plane 32 forms with the surface 33 in a range of 5 to 70°, where the number of emitted secondary electrons is larger than conventional cases. It is more preferable to set the angle α in a range of 5 to 55°, and still more preferable in a range of 10 to 40°. The reason for this can be considered as follows. With the angle α being in a range of 5 to 70°, the experimental results of the practical examples show that the number of emitted secondary electrons is larger than conventional cases for some reasons. With the angle α being in a range of 5 to 55°, or further in a range of 10 to 40°, the number of emitted secondary electrons is still larger.

Here, it is preferable that the size of the columnar crystals 31 is larger. To be more specific, it is preferable that the width w being the widest part of each columnar crystal 31 (see FIG. 5B) is in a range of 100 to 500 nm. This range is determined based on the following consideration. A columnar crystal with the width w being less than 100 nm has low single-crystallinity, and emits a smaller number of secondary electrons. On the other hand, a columnar crystal with the width w being 500 nm or more is difficult to form.

The protective layer 15 that is made up of the above-described columnar crystals is a thin-film that excels in secondary electron emission characteristics. In such a PDP, therefore, an address discharge can be performed in a preferable manner even with short address time, and further, generation of erroneous light emission can be reduced.

<Manufacturing Method for the PDP>

The following describes a method for manufacturing the PDP. The PDP is manufactured by first forming the front panel 10 and the back panel 20, and then bonding the front panel 10 and the back panel 20 together.

① Forming the Front Panel 10

The front panel 10 is formed as follows. The display electrodes 12 and 13 are formed on the front glass substrate 11, and the dielectric layer 14 is formed to cover the display electrodes 12 and 13. Then, the protective layer 15 is formed on the surface of the dielectric layer 14.

The display electrodes 12 and 13 each have a three-layer structure of a Cr-layer, a Cu-layer, and a Cr-layer, and each are formed by continuously sputtering Cr, Cu, and Cr in the stated order.

The dielectric layer 14 is formed to have a thickness of about 20 μm by applying a paste of a mixture of, for example, PbO 70 wt %, $B_2O_3$ 14 wt %, $SiO_2$ 10 wt %, $Al_2O_3$ 5 wt %, and an organic binder (α—terpineol in which 10% of ethyl cellulose is dissolved) by screen printing, and then baking the paste at 520° C. for 20 minutes.

The protective layer 15 is made of MgO. The protective layer 15 may be formed by sputtering, but here, it is formed by a vacuum deposition method using MgO as a target. A method for forming the protective layer 15 is described in detail later in this specification.

② Forming the Back Panel 20

The back panel 20 is formed as follows. The address electrodes 22 are formed on the back glass substrate 21 by continuously forming layers of Cr, Cu, and Cr in the stated order in the same manner as that for the display electrodes 12 and 13.

Following this, the dielectric layer 23 is formed by applying a paste containing a lead glass material by screen printing, and baking the applied paste in the same manner as that for the dielectric layer 14. Here, a lead glass material paste into which $TiO_2$ particles are added may be used, for the purpose of reflecting visible light emitted by the phosphor layers 25R, 25G, and 25B.

The barrier ribs 24 are formed by repeatedly applying a barrier rib paste containing a glass material using screen printing, and then baking the paste.

Following this, the phosphor layers 25R, 25G, and 25B are formed by applying phosphor ink in every groove formed between adjacent barrier ribs 24, for example, by an ink jet method.

③ Completing the PDP by Bonding the Panels Together

Following this, peripheral parts of the front panel 10 and the back panel 20 formed in the above-described way are bonded together using a glass material for a sealing layer. Then, the discharge space 26 divided by the barrier ribs 24 is exhausted to create a high vacuum (e.g., $8*10^{-7}$ Torr), and a discharge gas (e.g., an He—Xe inert gas or an Ne—Xe inert gas) is enclosed in the discharge space 26 at a predetermined pressure (e.g., 66.5 kPa to 106 kPa), to complete the PDP.

When the PDP is driven to perform display, a driving circuit (not shown) is mounted on the electrodes 12, 13, and 21. An address discharge is performed between display electrodes 12(13) and address electrodes 21 in cells in which light emission is intended, to generate wall charge in the intended cells. Then, a sustained discharge is performed by applying a pulse voltage between the display electrodes 12 and 13, to drive the PDP so as to perform display.

④ Method for Forming the Protective Layer 15

The protective layer 15 is formed using the vacuum deposition method that is characterized by high-speed film formation and relatively easy deposition even for a large substrate.

Figure 6:
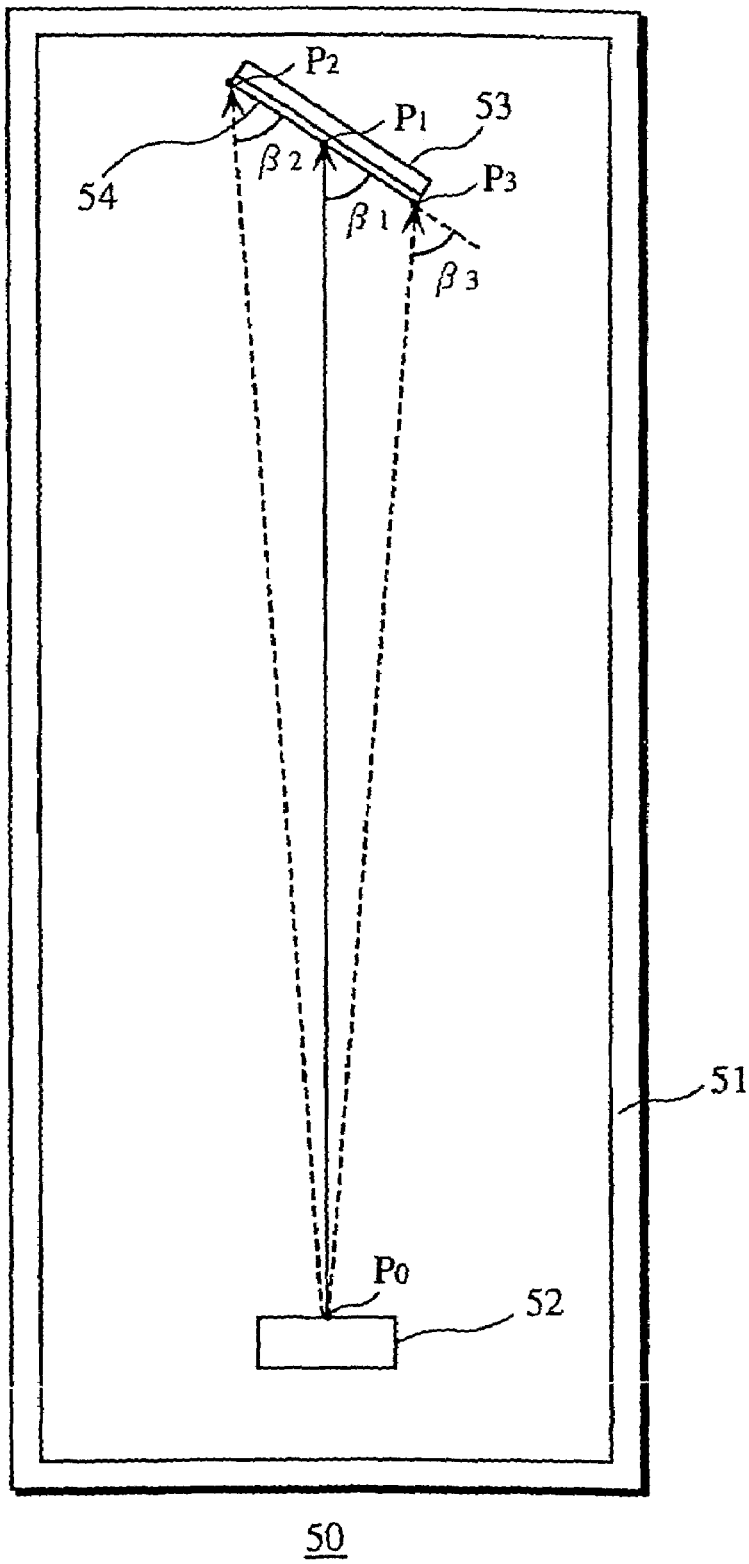
FIG. 6 shows a state where the protective layer is formed on a dielectric layer on a front glass substrate, using a vacuum deposition system.

FIG. 6 shows a schematic construction of a vacuum deposition system 50.

As the figure shows, the vacuum deposition system 50 includes a chamber 51 that is a closed chamber, a vacuum pump for depressurizing the inner space of the chamber 51, a heater (not shown) for heating a target 52 that is composed of MgO, and a heater (not shown) for heating the front glass substrate 53.

Within the chamber 51, the front glass substrate 53 on which the dielectric layer 14 is formed, and the target 52 that is composed of MgO are fixed by holders (not shown). The front glass substrate 53 and the target 52 are fixed in such a manner that the dielectric layer 14 on the front glass substrate 53 forms a predetermined angle with the target 52.

By setting this angle in a predetermined range described later, the protective layer that is made up of columnar crystals constructed by single crystals described above can be formed.

The central point of the target 52 is referred to as point P0, the central point of the dielectric layer 54 on the front glass substrate 53 is referred to as point P1, and both ends of the dielectric layer 54 on the front glass substrate 53 are referred to as points P2 and P3.

Angles that straight lines linking point P0 and each of points P1, P2, and P3 form with the surface of the dielectric layer 54 are respectively referred to as angles β1, β2, and β3. It is preferable that the target 52 and the front glass substrate 53 are fixed in such a manner that the angles β1, β2, and β3 are each exclusively within a range of 30 to 80°, and that the target material is not incident on the substrate at any angle out of this range. By doing so, the above-described angle that the flat plane 32 forms with the surface 33 can be fallen within a range of 5 to 70°, although it may depend on temperature conditions. More preferably, each of the angles β1, β2, and β3 is in a range of 45 to 80°, and still more preferably, in a range of 50 to 70°. By doing so, the single-crystallinity of the formed protective layer is considered to be improved for some reasons, resulting in secondary electron emission characteristics of the protective layer being improved remarkably. The deposition of the target 52 at such angles results in the protective layer 15 that excels in the secondary electron emission characteristics.

It should be noted here that the inner space of the chamber 51 is depressurized to about $1*10^{-2}$ Pa by the vacuum pump at the time of deposition. By heating the target 52 to a temperature of 2000° C. or higher with the use of the heater, MgO deposits on the dielectric layer 54 on the front glass substrate 53, thereby forming the protective layer. Also, it is preferable to heat the front glass substrate 53 to approximately 150 to 300° C., and more preferably to approximately 200° C. This is because experimental results verify that beyond this temperature range columnar crystals are formed to have low single-crystallinity. Also, when the front glass substrate 53 is small or when the distance between the target 52 and the front glass substrate 53 is large, the angles β1, β2, and β3 may be regarded as substantially the same.

<Effects>

As described above, the vacuum deposition that makes the target material incident on the substrate at a predetermined angle enables the protective layer that excels in secondary electron emission characteristics to be formed in a relatively short time period (about 5 minutes).

To be more specific, the protective layer formed in this way is a dense layer of columnar crystals that excel in single-crystallinity. Each columnar crystal has high single-crystallinity, and further, has, at its exposed end, a flat plane equivalent to (100) plane that forms a predetermined angle with the surface of the protective layer. This protective layer, therefore, has remarkably improved secondary electron emission characteristics as compared with a conventional protective layer.

In the PDP including such a protective layer, an address discharge can be performed in a preferable manner even with short address time, and generation of erroneous light emission can be reduced as compared with conventional cases.

PRACTICAL EXAMPLES

(1) Samples of Practical Examples

Samples S1 to S6 of Practical Examples

For samples S1 to S6 of practical examples, protective layers made of MgO were formed on glass substrates using the vacuum deposition method described in the above embodiment, each varying in the angle β1 that the straight line linking the central point of the target (MgO) and the central point of the glass substrate forms with the glass substrate at the time of vacuum deposition. For samples S1 to S6, the angle β1 was respectively set at 80°, 70°, 60°, 50°, 40°, and 30°.

Samples S7 to S14 of Practical Examples

For samples S7 to S14 of practical examples, protective layers made of MgO were formed on glass substrates using the vacuum deposition method described in the above embodiment, each varying in the angel α that the flat plane of the columnar crystal forms with the surface of the protective layer. For samples S7 to S14, the angle β1 that the target (MgO) forms with the glass substrate was adjusted at the time of vacuum deposition in such a manner that the angel α was respectively set at 5°, 10°, 20°, 30°, 40°, 50°, 60° and 70°.

(2) Samples of Comparative Examples

Sample R1 of Comparative Example

For sample R1 of a comparative example, a protective layer was formed on a glass substrate using the same method as that for samples S1 to S6 of the practical examples. Note here that this sample of the comparative example differs from the samples of the practical examples in that the angle β1 was set at 90° at the time of vacuum deposition.

Sample R2 of Comparative Example

For sample R2 of a comparative example, a protective layer was formed on a glass substrate using the same method as that for samples S7 to S14 of the practical examples. Note here that this sample of the comparative example differs from the samples of the practical examples in that the angle β1 formed by the glass substrate with the target was adjusted at the time of vacuum deposition in such a manner that the angle α was set at 0°.

It should be noted that at the time of vacuum deposition of the protective layer for each of the samples of the practical examples and the samples of the comparative examples, the pressure within the vacuum deposition system was set at $1*10^{-2}$ Pa, and the glass substrate was heated to 200° C.

(3) Experiments

① Experimental Method

For the samples of the practical examples and the samples of the comparative examples, the number of emitted secondary electrons was measured. The measured numbers of emitted secondary electrons were compared and examined, for various values of the angle β1 at which the target material was incident on the glass substrate, and for various values of the angle α that the flat plane of the columnar crystal formed with the surface of the protective layer.

② Experimental Conditions

Irradiation Ion: Ne ion

Acceleration Voltage: 500V

The above acceleration voltage was applied to accelerate irradiation of the protective layer with Ne ions, and the number of secondary electrons emitted from the protective layer was detected by a collector.

(4) Results and Considerations

Figure 7:
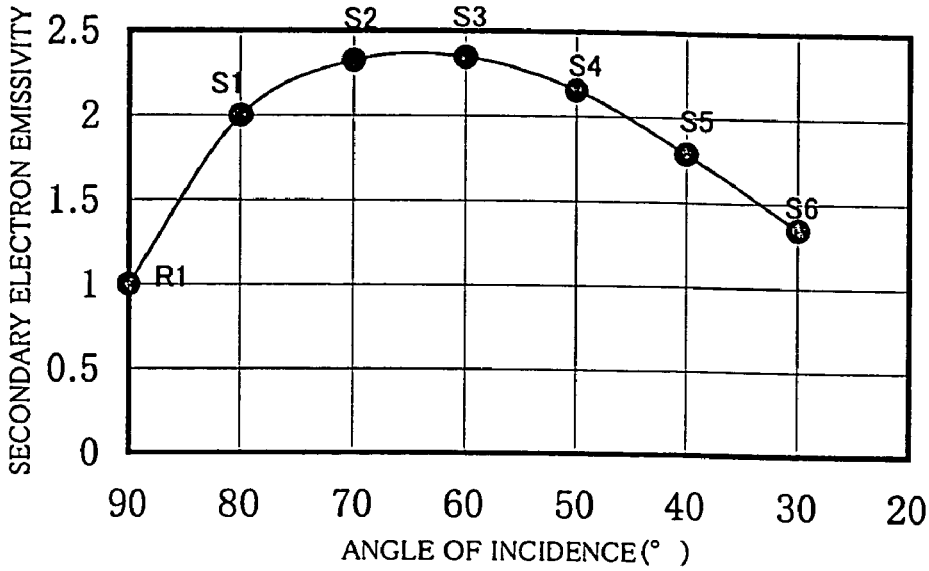
FIG. 7 is a graph showing a secondary electron emissivity of the protective layer plotted for an angle at which a protective layer forming material is incident on a substrate.
Figure 8:
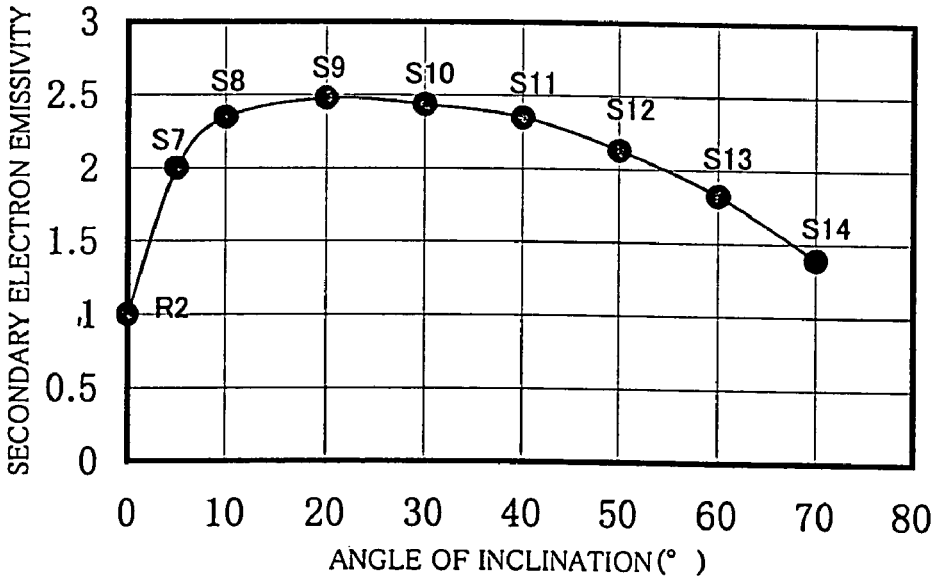
FIG. 8 is a graph showing a secondary electron emissivity of the protective layer plotted for an angle that a flat plane of a columnar crystal in the protective layer forms with a surface of the protective layer.

FIGS. 7 and 8 show the experimental results.

FIG. 7 shows the experimental results relating to samples S1 to S6 of the practical examples and sample R1 of the comparative example. The figure shows a secondary electron emissivity plotted for the angle β1 at which the target material is incident on the glass substrate. It should be noted here that the "secondary electron emissivity" is a ratio of the number of secondary electrons emitted from each sample with respect to the number of secondary electrons emitted from sample R1 of the comparative example.

As the figure shows, when the angle of incidence β1 at the time of vacuum deposition is in a range of 30 to 80°, the protective layer emits a larger number of secondary electrons than the protective layer of sample R1 of the comparative example (90°) that corresponds to a conventional technique. In particular, when the angle of incidence β1 is in a range of 45 to 80°, the number of emitted secondary electrons is twice or more of that of the comparative example. Further, when the angle of incidence β1 is in a range of 50 to 70°, the number of emitted secondary electrons is 2.2 times or more of that of the comparative example. This range of 50 to 70°, therefore, is considered the most preferable in view of increasing the number of secondary electrons to be emitted.

FIG. 8 shows the experimental results relating to samples S7 to S14 of the practical examples and sample R2 of the comparative example. The figure shows a secondary electron emissivity plotted for the angle α1 that the flat plane of the columnar crystal forms with the surface of the protective layer. It should be noted here that the "secondary electron emissivity" is a ratio of the number of secondary electrons emitted from each sample with respect to the number of secondary electrons emitted from sample R2 of the comparative example.

As the figure shows, when the angle of incidence β1 is in a range of 5 to 70°, the protective layer emits a larger number of secondary electrons than the protective layer of sample R2 of the comparative example. In particular, when the angle of incidence β1 is in a range of 5 to 55°, the number of emitted secondary electrons is twice or more of that of the comparative example. Further, the angle of incidence β1 being in a range of 10 to 40° is considered the most preferable because the number of emitted secondary in this range is 2.3 times or more of that of the comparative example.

It should be noted here that little difference was observed in resistance against spattering for the samples of the practical examples and the comparative examples.

<Modifications>

① Although the above embodiment describes the case where a layer made of MgO is used as a protective layer, the same effect of the present invention can be obtained when a layer made of a material having a face-centered cubic lattice crystal structure, such as beryllium oxide, calcium oxide, strontium oxide, and barium oxide, is used.

② The above embodiment describes the case where the protective layer is formed using a vacuum deposition method. An electron beam (EB) deposition method may be used as this vacuum deposition method. Further, the same effect of the present invention can be obtained when sputtering is used instead of the vacuum deposition method.

③ Although the above embodiment describes the case where a thin-film that excels in secondary electron emission characteristics is used as a protective layer of a PDP, the present invention should not be limited to such. The present invention can be applied to a thin-film used in a cathode of a field emission display panel for which improved electron emission characteristics is desired.

INDUSTRIAL APPLICATION

A display panel such as a PDP that is manufactured using the electron emission thin-film of the present invention is effective as a display panel for use in a computer, a television, and the like, and is particularly effective as a display panel for which high definition is required.

The invention claimed is:

1. An electron emission thin-film that is formed on a substrate by densely arranging a plurality of columnar crystals so as to extend from the substrate, the columnar crystals being composed of an electron emission material to form a thin film, wherein the plurality of columnar crystals extend into one direction, wherein a top portion of at least one of the plurality of columnar crystals is formed by one flat plane that is inclined with respect to a plane including the electron emission thin-film, and wherein edges of the flat plane of the at least one of the columnar crystals coincides with exposed-end edges of lateral surfaces of at least another of the plurality of columnar crystals.

2. An electron emission thin-film according to claim 1, wherein the flat plane is inclined at an angle of 5 to 70° with respect to a plane included within a surface of the electron emission thin-film.

3. An electron emission thin-film according to claim 1, wherein the flat plane of at least one of the columnar crystals is equivalent to a (100) plane of crystal orientation.

4. An electron emission thin-film according to claim 1, wherein an extending direction of each of the columnar crystals is equivalent to a <211> direction of crystal orientation.

5. An electron emission thin-film according to claim 1, wherein a width of each of the columnar crystals is in a range of 100 to 500 nm.

6. An electron emission thin-film according to claim 1, wherein the columnar crystals are composed of magnesium oxide.

7. An electron emission thin-film formation method including a step of forming a protective layer made of a single-layered thin-film by depositing a material on a substrate, wherein the protective layer formation step is performed in an atmosphere of $1\times10^{-2}$ Pa, with the substrate heated within a temperature range of 150 to 300° C. and a target material for the protective layer heated to 2000° C. or higher, and wherein the material is deposited on the substrate in such a manner that an angle at which the material is incident on the substrate is in a range of 30 to 80° to form a final surface configuration of the protective layer.

8. An electron emission thin-film formation method according to claim 7, wherein the material for forming the thin-film is magnesium oxide.

9. An electron emission thin-film formation method according to claim 7, wherein a vacuum deposition method is employed to form the electron emission thin-film.

10. A plasma display panel that includes a front panel covered by a protective layer and a back panel disposed to oppose the front panel, wherein the protective layer is an electron emission thin-film formed by arranging a plurality of columnar crystals so as to extend from the front panel side, the columnar crystals being composed of an electron emission material, the columnar crystals extending into one direction.

a top portion of each of the columnar crystals is formed by one flat plane that is inclined with respect to a plane including the electron thin-film, and edges of the flat plane coincide with exposed-end edges of lateral surfaces of at least one of an adjacent columnar crystal of the plurality of columnar crystals.

11. A plasma display panel according to claim 10, wherein the flat plane is inclined at an angle of 5 to 70° with respect to the plane including the electron emission thin-film.

12. A plasma display panel according to claim 10, wherein the flat plane of each of the columnar crystals is equivalent to (100) plane of crystal orientation.

13. A plasma display panel according to claim 10, wherein an extending direction of each of the columnar crystals is equivalent to <211> direction of crystal orientation.

14. A plasma display panel according to claim 10, wherein a width of each of the columnar crystals is in a range of 100 to 500 nm.

15. A plasma display panel according to claim 10, wherein the columnar crystals are composed of magnesium oxide.

16. A plasma display panel according to claim 15 with a (100) plane of crystal orientation and a flat plane surface inclined at an angle of 10° to 40°.

17. A plasma display panel manufacturing method including, a protective layer formation step of forming a protective layer made of a single-layered thin-film by depositing a material on a front panel; and a disposing step of disposing a back panel so as to oppose the front panel, wherein the disposing step is performed in an atmosphere of $1\times10^{-2}$ Pa, with the substrate heated within a temperature range of 150 to 300° C. and a protective material heated to 2000° C. or higher, and wherein in the protective layer formation step, the protective material is deposited in such a manner that an angle at which the protective material is incident on the front panel is in a range of 30 to 80°.

18. A plasma display panel manufacturing method according to claim 17, wherein the material for forming the thin film is magnesium oxide.

19. A plasma display panel manufacturing method according to claim 17, wherein a vacuum deposition method is employed to form the protective layer.

20. In a plasma display panel manufacturing method, the improvement comprising:

providing a glass substrate panel with electrodes covered with a dielectric layer at a pressure of about 0.01 Pascals;

heating the glass substrate to a temperature within a range of 150° C. to 300° C.;

providing a protective layer target of a face-centered cubic lattice crystal structure material at a position wherein a plane containing a surface of the dielectric layer is inclined within a range of 30° to 80° relative to a plane containing a surface of the target;

heating the target to a temperature range of 2000° C. or higher to release the target material from the target;

forming a protective layer by depositing the released target material on the dielectric layer to form a dense protective layer of single-crystallinity columnar crystals with exposed ends having a flat plane equivalent to a (100) plane; and attaching the coated glass substrate panel opposite a complementary panel.

21. The plasma display panel manufacturing method of claim 20 wherein the glass substrate panel protective layer includes flat inclined surfaces having a triangle perimeter on the exposed ends of the columnar crystals when viewed above and perpendicular to a plane containing the surface width of the protective layer, and a width of the largest triangular side is within a range of 100 nm to 500 nm.

22. The plasma display panel manufacturing method of claim 21 wherein the face-centered cubic lattice crystal structure material is magnesium oxide.

23. The plasma display panel manufacturing method of claim 21 where the formulation of a protectively layer is performed exclusively by one of a vacuum deposition method and an electron beam deposition method.

24. The plasma display panel manufacturing method of claim 21 wherein the face-centered cubic lattice crystal structure material is selected from beryllium oxide, calcium oxide, strontium oxide and barium oxide.

25. The plasma display panel manufacturing method of claim 20 wherein the target material is deposited for a time period of approximately 5 minutes.

26. The plasma display panel manufacturing method of claim 20 wherein the protective layer is utilized without any post depositing finishing steps.

* * * * *

UNITED STATES PATENT AND TRADEMARK OFFICE

CERTIFICATE OF CORRECTION

PATENT NO. : 7,161,297 B2
APPLICATION NO. : 10/275795
DATED : January 9, 2007
INVENTOR(S) : Kotera et al.

It is certified that error appears in the above-identified patent and that said Letters Patent is hereby corrected as shown below:

In Claim 10, Column 13, line 9, the "." after direction should be --,--.

Signed and Sealed this

Seventeenth Day of April, 2007

JON W. DUDAS
*Director of the United States Patent and Trademark Office*